US005129250A

United States Patent [19]

Palma et al.

[11] Patent Number: 5,129,250

[45] Date of Patent: Jul. 14, 1992

[54] STRETCH-REDUCING MILL FOR ROLLING TUBES

[75] Inventors: Vincenzo Palma; Ettore Cernuschi, both of Milan, Italy

[73] Assignee: Innse Innocenti Santeustacchio S.p.A., Brescia, Italy

[21] Appl. No.: 602,681

[22] Filed: Oct. 24, 1990

[30] Foreign Application Priority Data

Nov. 17, 1989 [IT] Italy ..... 22421 A/89

[51] Int. Cl.[5] ..... B21B 17/00; B21B 35/10

[52] U.S. Cl. ..... 72/234; 72/249

[58] Field of Search ..... 72/205, 234, 226, 249

[56] References Cited

U.S. PATENT DOCUMENTS

| | | | |
|---|---|---|---|
| 3,357,225 | 12/1967 | Grube | 72/234 |
| 4,000,637 | 1/1977 | Gerhards et al. | 72/226 |
| 4,306,440 | 12/1981 | Demny | 72/234 |
| 4,388,819 | 6/1983 | Moltner | 72/234 |

*Primary Examiner*—Robert L. Spruill
*Assistant Examiner*—D. M. Gurley
*Attorney, Agent, or Firm*—Birch, Stewart, Kolasch & Birch

[57] ABSTRACT

A stretch-reducing mill comprises a plurality of rolling stands laid side-by-side between an input stand and an output stand. A first group of stands adjacent to one another is next to the input stand and a second group of stands adjacent to one another is next to the output stand. The first group of stands is operated through a differential drive with two motors; the second group of stands is driven by independent single motors.

6 Claims, 4 Drawing Sheets

STRETCH-REDUCING MILL FOR ROLLING TUBES

DESCRIPTION

Field of the Invention

This invention relates to a stretch-reducing mill for rolling tubes.

BACKGROUND OF THE INVENTION

Rolling mills of this kind comprise a plurality of side-by-side stands whose rolls define a rolling path. Along this rolling path, a tube is stretched as a consequence of the different rotational speeds of the rolls, which increase progressively from the input stand to output stand.

On the above rolling mills, therefore, each stand must be driven at a defined speed, that is, the mill must be operated to a "speed profile", meaning the aggregate of the speeds of the various stands when plotted as a graph with the sequential order numbers of the stands on the abscissa and the speed of each stand ont he rodinate, is described by a point set lying on a curve.

In order to perform different rolling operations, as well as to maintain control of any rolling operation, it is mandatory that the speed profile be changeable.

Several ways of changing the stand speeds have been known. The conceptually most straghtforward approach is that of providing each stand with a single independent motor of its own. Thus, maximum flexibility and adjustability of the speed curve can be achieved. However, in view of the large number of stands supplied on rollingmills of this type (up to 20 or 30 stands), the system is difficult to manage due to the large number of degrees of freedom; this enforces the availability of highly complex computers and extremely sophisticated sofware.

To overcome these drawbacks, the so-called differential drives or group drives have been developed.

A first of these nsee German Patent No. DAS-1054408) provides a primary motor and an auxiliary motor, drivingly connected to all the stands through respective differential transmissions; each stand operates at a speed resulting from the combined speedds from the primary motor and the auxiliary motor, each as suitably stepped down. The primary motor will impart a basic speed profile, and the auxiliary motor a corrective profile of the basic profile.

A second type of groups drives (see U.S. Pat. No. 4,388,819) provides a primary motor and two auxilieary motors, drivingly connected to the stands through respective differential transmissions; the primary motor is connected to all the stands, whereas each auxiliary motor is connected to a respective group of stands. Consequently, the primary motor will impart a basic speed profile, and the auxiliary motors corrective profiles of the basic speed profile, each for its respective group of stands.

A third type of drive by groups (see U.S. Pat. No. 4,768,370) provides for the stands to be split into several groups of adjacent stands; the bordering stands between groups are driven directly by respective motors, whereas the intermediate stands are linked to both of the nearest bordering stands through respective differential transmissions. The intermediate stands run at speeds which depend on those of the nearest bordering stands; when the speeds of the bordering stands are varied, the speeds of the intermediate stands also vary accordingly.

The groups drives just outlined hereinabove constitute a compromise between a drive by single motors and a fully rigid drive, i.e. a drive wherein the drive ration of each stand and the single motor is constant.

The flexibility of these group drives is highest with the third type and lowest with the first type; conversely, simplicity of construction and convenience of practical management are highest with the first type and lowest with the third type. In general, it may be concluded that the choise from the various types of viable drives is a typical choice by compromise: if preference is to be given to certain features, other features must inevitably be given up.

SUMMARY OF THE INVENTION

The problem that underlies this invention is to provide a stretch-reducing mill for rolling tubes which, by eluding the rationale of the aforesaid compromise, allows the main advantages of the various known systems to be achieved at one time.

This problem is solved, according to the invention, by a stretch-reducing mill for rolling tubes, comprising a plurality of rolling stands laid side-by-side between an input stand and an output stand, and being characterized in that it comprises a first group of said stands adjacent to one another, next to the input stand, and a second group of said stands adjacent to one another, next to the output stand, the first group of stands being operated through a differential drive with two motors, and the second group of stands being driven by independent single motors.

It has been found, in fact, that the greatest benefits are to be derived from the individual drive arrangement in the second portion of the rolling mill, where the tube is finish processed. In fact, optimum finish, i.e. a finish with polygonal faceting of the tube (a phenomenon whereby the interior wall of a round tube is actually a polygonal one) held within very narrow tolerances, can be obtained by minimizing the tube ovalization; this can only be achieved through an exact control of the tube tension between the stands, that is of the speed differential between individual pairs of adjacent stands. This control can only be provided by an individual motor type of drive.

Furthermore, an individual motor drive for the second group of stands enables the speed profile of the finishing stands to be optimized even where the latter are not the last stands in the mill (partial utilization of the mill).

On the other hand, it has been found that the superior flexibility of an individual motor drive is not strictly necessary in the first portion of the mill. Of special interest in the first portion of the mill is instead simplicity of management and setting.

It is, in fact, in that area that the so-called "crop end control" (control of thickening at the ends) should be applied, which is a specific time variation in the speed profile during the mill loading and unloading transients.

In fact, should the speeds remain time-course constant, the end regions of the tube would be thicker because less stretched; during the loading step, the pulling action of the stands located downstream is absent, and during the unloading step the pulling action from the upstream-located stands is missing. This phenomenon can be accommodated by increasing the speed differentials (i.e. by making the speed profile steeper) during the trasients.

This operation is specially difficult to manage because it overlaps the normal spatial setting (between stands) with a time setting of the speeds. Thus, the availability of a drive arrangement group inthe first portion of the mill has proved to be highly advantageous because of it being easier to manage.

Another factor which facilitates application of the crop end control to differential drive or drive-by-groups stands is the increased inertia of the system. In fact, on the end of a tube being rolled reaching a stand in the transient, a sharp increase occurs in the rolling torque of that stand. If the stand is an individually driven one, to avoid slowing down the stand, the power delivered to it from the motor must be increased, which is reflected, of course, in further complication in the management of the crop end control. If the stand is, instead, a part of a differential drive group, the rolling torque increase is discharged through the entire group, and can be accommodated much more easily.

Preferably, the first stand group would include the input stand and the second group the output stand.

Preferably, the differential drive system for the first stand group comprises a primary motor which imparts a basic speed profile to all the stands in the first group, and an auxiliary motor which imparts corrections of said profile to all the stands inthe firt group, with the possible exception of one stand. Especially where the speed of the last stand in the first group is just dependent on the primary motor, the continuity of action from the stands in the first group to the following ones can be managed much more easily.

Preferably, all the mill stands are comprehended in either the first group or the second.

Further features and advantages of a rolling mill according to the invention will be more clearly understood from the following detailed description of a preferred embodiment thereof, to be taken in conjunction with the accompanying drawings.

DETAILED DESCRIPTION OF THE INVENTION

Figure 1:
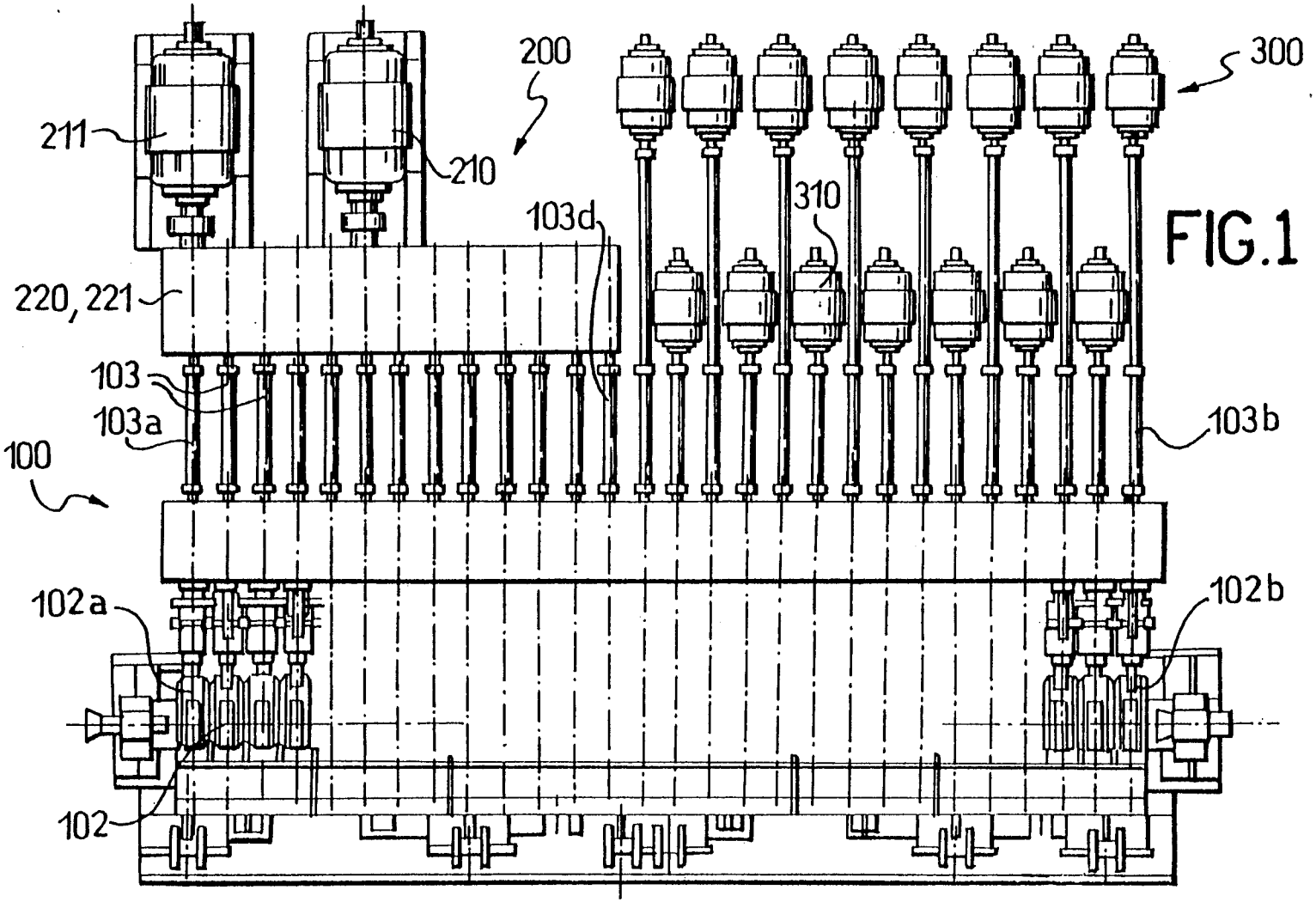
FIG. 1 is a schematic plan view of the rolling mill according to the invention.
Figure 2:
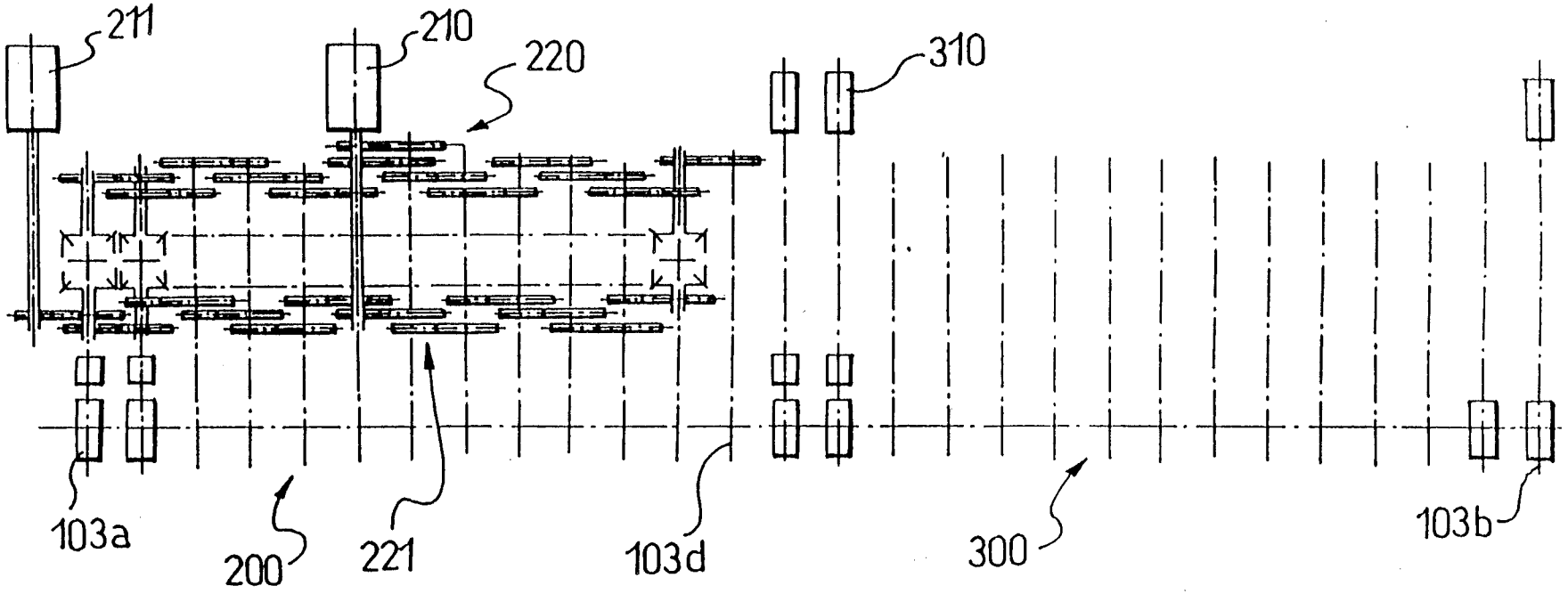
FIG. 2 is a kinematic representation fo the drives of the rolling mill shown in FIG. 1.
Figure 3:
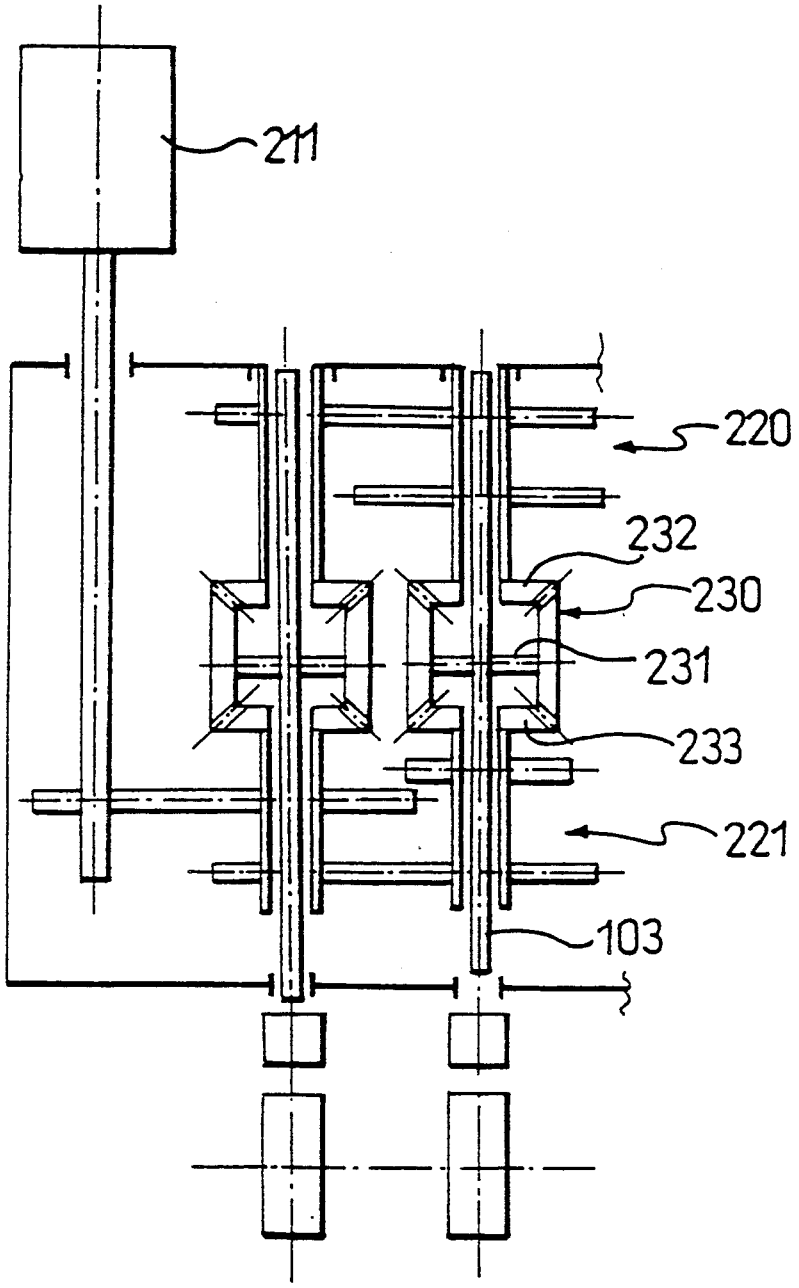
FIG. 3 is an enlarged scale detail view of the diagram in FIG. 2.

In the drawing figures, generally shown at 100 is a stretch-reducing mill for rolling tubes comprising a plurality of rolling stands 102 arranged side-by-side. Each stand 102 has respective rolling process rolls (not shown) driven through a respective adapter 103.

Specifically, the stands 102 form an aggregate at twenty eight stands, from an input stand **102*a* (with an adapter 103*a*) to an output stand 102*b* (with an adapter 103*b***).

Of the twenty-eight stands 102, the first thirteen stands form a first group, generally indicated at 200, and the remainder a second group, generally indicated at 300. The stands in the first group 200 are driven through a differential drive system, whereas the stands int he second group 300 are driven by an independent individual motor drive system.

The drive to the first group 200 of stands comrpises a primary motor 210 and a secondary motor 211; the motor 210 is connected to all the adapters 103 of the stands 102 in the group 200 by means of a gear-type transmisison 220, and the motor 211 is connected to all the adapters 103 of the stands 102 in the group 200—excepting adapter **103*d* of the last stand 102*d* in the first group—by means of a gear—type transmission 221. Keyed to each adapter 103, excepting adapter 103*d*, is a spider unit 231 of a differential gear 230; the crown wheels 232 and 233 of the differential 230 are mounted idle to the adpater 103 and connected drivingly to the transmissions 220 and 221, respectively, to receive their motion from the motors 210 and 211. The adapter 103*d* is instead keyed directly to a gear of the transmission 220, and receives its motion fromthe motor 210** alone.

The drive to the second group 300 of stands comrpises instead independent motors 310, each connected to a respective adapter 103.

Figure 4:
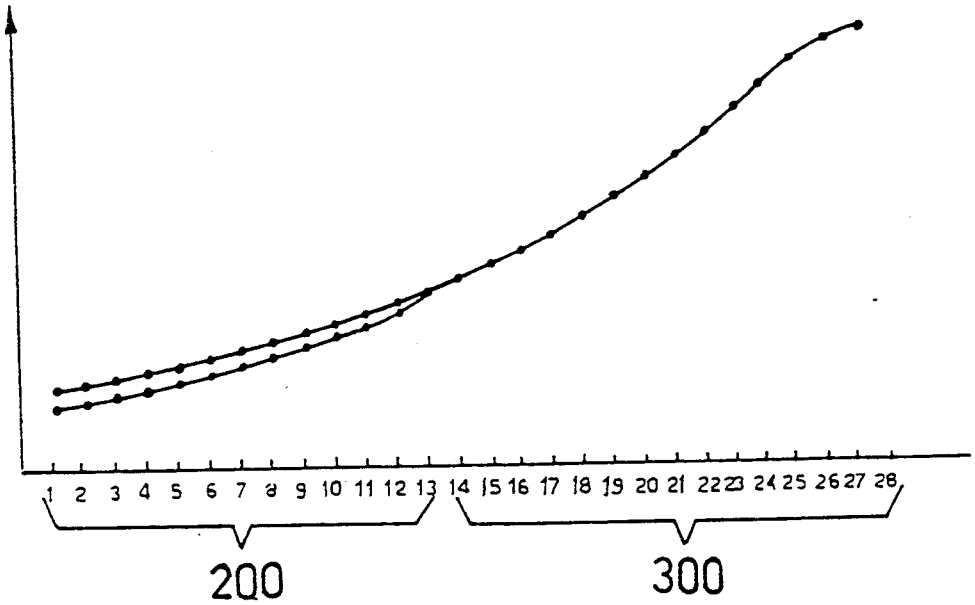
FIG. 4 is a graph of the speeds of the rolling mill in FIG. 1.

The graph of FIG. 4 will make the operaiton of the rolling mill 100 more easily understood. Shown as abscissa on said graph are the rolling stands progressively numbered from 1 to 28, and as ordinate, the rotational speed of each stand. With the stands in the second group 300 (from stand number 14 to number 28), the rotational speed can be varied individually, as required.

For the stands in the first group 200 nfrom stand No. 1 to No. 13), there are shown two different speed profile curves, of which the upper (less steep) one illustrates steady-state operation, and the bottom (steeper) one illustrates operation at the start of the rolling process or during the trasient of tube exit from the mill. During the crop end control step, the speed profile curve moves from the steeper curve to the less steep one at the start of the rolling process, and from the less steep curve to the steeper one during the step of tube eixt from the mill. It should be noted that the speeds of the stands in this first group 200 cannot be varied independently, but only jointly together. It follows that, by varying the rpm of the auxiliary motor 211, the curve cannot be changed, but only shifted upwards or downwards, with the speed of the stand which is driven by the primary motor 210 alone as a fixed point. In the example, shown, this stand (referred to as the center stand of the group) would be stand No. 13, and its speed represented by point A; as mentioned above, however, the center stand could be No. 1 or any one from No. 1 to No. 13, depending on design options.

Figure 5:
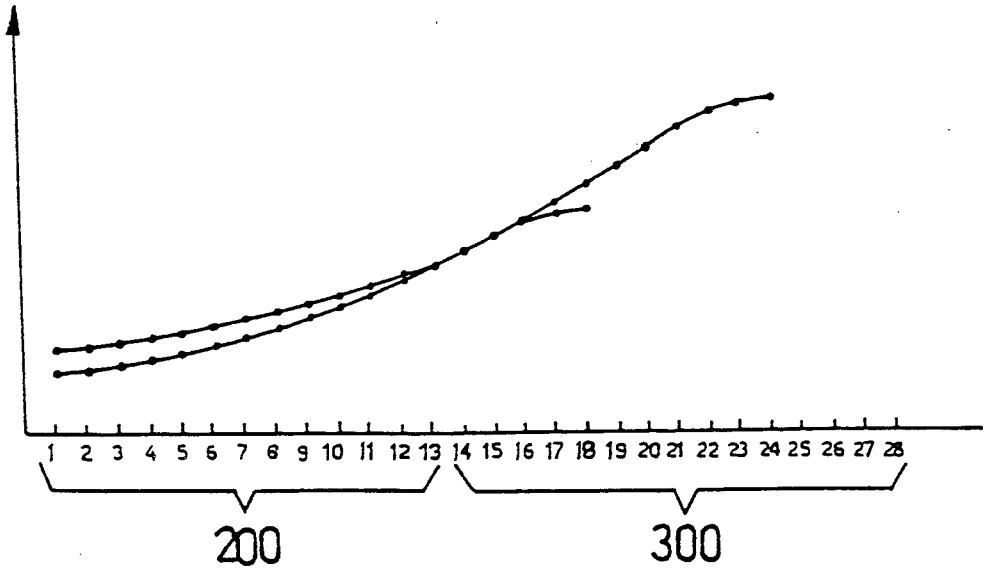
FIG. 5 is a graph similar to the one shown in FIG. 4, but relating to a condition of partial utilization of the rolling mill.

Some rolling processes may make it advisable to only operate some of the stands 102 of the rolling mill 100, e.g. the initial eighteen or twenty four stands (see FIG. 5). In this case, because of the second group 300 being driven by separate motors 310, the unused ones of the stands 102 may be stopped and the speed profile of the stands 102 in use be adjusted accordingly.

I claim:

1. A stretch-reducing mill for rolling tubes, comprising:

a plurality of rolling stands laid side-by-side between an input stand and an output stand, said plurality of rolling stands comprising:

a first group of said rolling stands adjacent one another including said input stand;

a second group of said rolling stands adjacent one another next to said output stand;

a differential drive with two motors for operating said first group of stands; and a plurality of independent single motors for driving said second group of stands;

said differential drive to said first group of stands comprising a primary motor imparting a basic speed profile to all of said stands in said first group, and an auxiliary motor imparting corrections of said basic speed profile to all of said stands in said first group except for said input stand.

2. The stretch-reducing mill of claim 1, wherein said output stand is included in said second group of stands.

3. The stretch-reducing mill of claim 1, wherein all of said plurality of stands are included within said first group or said second group.

4. A stretch-reducing mill for rolling tubes, comprising:

a plurality of rolling stands laid side-by-side between an input stand and an output stand, said plurality of rolling stands comprising:

a first group of said rolling stands adjacent one another including said input stand;

a second group of said rolling stands adjacent one another next to said output stand;

a differential drive with two motors for operating said first group of stands; and a plurality of independent single motors for driving said second group of stands;

said differential drive to said first group of stands comprising a primary motor imparting a basic speed profile to all of said stands in said first group, and an auxiliary motor imparting corrections of said basic speed profile to all of said stands in said first group except for the last, removed from said input stand.

5. The stretch-reducing mill of claim 4, wherein said output stand is included in said second group of stands.

6. The stretch-reducing mill of claim 4, wherein all of said plurality of stands are included within said first group or said second group.

* * * * *